US008935948B1

(12) United States Patent
Gregory

(10) Patent No.: US 8,935,948 B1
(45) Date of Patent: Jan. 20, 2015

(54) ELECTRIC-HYDRAULIC RIVETER AND CRIMPER HAND POWER TOOL

(71) Applicant: Jack T Gregory, Sonoma, CA (US)

(72) Inventor: Jack T Gregory, Sonoma, CA (US)

( * ) Notice: Subject to any disclaimer, the term of this patent is extended or adjusted under 35 U.S.C. 154(b) by 0 days.

(21) Appl. No.: 14/182,255

(22) Filed: Feb. 17, 2014

Related U.S. Application Data

(60) Provisional application No. 61/765,805, filed on Feb. 17, 2013.

(51) Int. Cl.

| | |
|---|---|
| ***B21J 9/18*** | (2006.01) |
| ***B30B 1/32*** | (2006.01) |
| ***B21D 9/08*** | (2006.01) |
| ***B21J 15/20*** | (2006.01) |
| ***B21J 15/10*** | (2006.01) |

(52) U.S. Cl.
CPC ..... *B21J 15/20* (2013.01); *B21J 15/105* (2013.01)
USPC .. 72/453.15; 72/453.08; 100/43; 100/269.15; 60/477

(58) Field of Classification Search
USPC ..... 72/453.06, 453.15, 453.16; 100/35, 43, 100/269.15; 60/477, 479
See application file for complete search history.

(56) References Cited

U.S. PATENT DOCUMENTS

| | | | | |
|---|---|---|---|---|
| 4,031,619 | A | 6/1977 | Gregory | |
| 4,248,077 | A | 2/1981 | Gregory | |
| 4,263,801 | A | 4/1981 | Gregory | |
| 4,342,216 | A | 8/1982 | Gregory | |
| 4,489,471 | A | 12/1984 | Gregory | |
| 4,735,048 | A | 4/1988 | Gregory | |
| 5,802,850 | A * | 9/1998 | Kimura | 60/479 |
| 6,415,641 | B1 * | 7/2002 | Wagner | 72/393 |
| 6,532,635 | B1 | 3/2003 | Gregory | |
| 6,986,274 | B2 * | 1/2006 | Lefavour et al. | 72/453.16 |
| 7,165,439 | B2 * | 1/2007 | Lefavour et al. | 72/453.16 |
| 7,421,877 | B2 * | 9/2008 | Frenken | 72/453.06 |
| 8,056,473 | B2 * | 11/2011 | Frenken | 72/453.16 |
| 8,151,703 | B2 * | 4/2012 | Schweizer et al. | 72/453.15 |
| 8,307,525 | B2 | 11/2012 | Gregory | |
| 2003/0188566 | A1 * | 10/2003 | Lefavour et al. | 72/453.16 |

* cited by examiner

*Primary Examiner* — David B Jones
(74) *Attorney, Agent, or Firm* — Gary Hoenig

(57) ABSTRACT

An electrically-hydraulically powered rivet setting and crimping hand power tool is provided, having a battery driven electric motor mechanically powering an offset drive cam through a dual planetary drive gear, the drive cam being in direct mechanical contact with a dual volume, dual stage concentrically delivering longitudinally reciprocating piston pump being in direct hydraulic communication with a work engaging hydraulic cylinder surrounding a centrally fixed and stationary work piece puller shaft, wherein the work engaging hydraulic cylinder is thrust forward around the work piece puller shaft when the tool is activated thereby providing the mechanical motion to activate a user provided riveter nose assembly attachment. When activated by a trigger mechanism, the work engaging cylinder moves forward relative to the centrally fixed work piece puller shaft having a user provided riveter tool nose assembly attachment positioned such that a rivet fastener pin is pulled away from the rivet relative to the surrounding work engaging cylinder thereby fixing the rivet in place. The centrally fixed work piece puller shaft further comprises a hydraulically activated work piece extraction mechanism. A pressure relief trigger is further provided so as to retract the work engaging cylinder upon setting a rivet fastener. An alternate embodiment of the tool receives a user provided crimping nose assembly attachment may optionally be fitted wherein the work piece engaging cylinder motion relative to the centrally fixed work piece puller shaft is translated into a crimping action.

14 Claims, 6 Drawing Sheets

ELECTRIC-HYDRAULIC RIVETER AND CRIMPER HAND POWER TOOL

RELATED APPLICATIONS

This non-provisional utility patent application filed in the United States Patent and Trademark Office claims the benefit of U.S. Provisional Application Ser. No. 61/765,805 filed Feb. 17, 2013 and whose disclosure is hereby incorporated by reference.

FIELD OF INVENTION

The present invention relates to rivet setting and crimping hand power tools, and more particularly to a such tools which are electrically-hydraulically actuated.

BACKGROUND OF THE INVENTION

Rivets are widely used in the construction of vehicles and equipment. Rivets are also used for many repair applications particularly in the aviation industry. Crimps are widely used particularly for repairing linage such as power lines. Riveter tools are used for setting riveting multi-piece fasteners such as pop rivets. The tools are specifically designed for setting a particular rivet design. Setting a rivet can require a significant amount of force, exceeding 10,000 PSI, to be applied to the fastener, consequently riveter tools for larger rivets are typically heavy, bulky, often requiring an external power source such as a pneumatic supply, and typically incorporating complex hydraulics. Alternatively, manually powered tools often require repetitive pumping action of manual levers so as to achieve the required forces on a work piece for proper installation of the rivet. Rivet setting tools are utilized in many manufacturing and maintenance applications. In maintenance applications, the tools are often used in field locations that are absent power sources or applications presenting awkward access for external electric or pneumatic supply lines. Additionally, manually powered tools are fatiguing for the user. Ideally, a rivet setting tool required for the typical maintenance application such as aircraft and vehicle repair should be lightweight, self powered and provide sufficient load capacity to set rivets. Similar limitations are presented when using crimping tools, again, particularly in maintenance applications such as power line repair.

What is needed is an improved hand power tool being self powered, lightweight, and adaptable for riveting and crimping applications whilst also providing sufficient load force for setting large rivets and crimps used in manufacturing and field maintenance operations.

SUMMARY OF THE INVENTION

Accordingly, the present invention is directed to a new electric-hydraulic hand power tool, and, more specifically, a self powered, low cost, lightweight tool having the capability to apply high loads in excess of 10,000 PSI for rivet and crimp setting, thereby substantially obviating one or more of the problems due to the limitations and disadvantages of the related art.

In the present invention an electrically-hydraulically powered rivet setting and crimping hand power tool is provided, having a battery driven electric motor mechanically connected to an offset drive cam by a planetary drive gear, the drive cam being in direct mechanical contact with a dual volume, dual stage concentrically delivering longitudinally reciprocating piston pump being in direct hydraulic communication with a work engaging hydraulic cylinder surrounding a centrally fixed and stationary work piece puller shaft, wherein the work engaging hydraulic cylinder is thrust forward around the work piece puller shaft when the tool is activated thereby providing the mechanical motion to activate a user provided riveter nose assembly or crimping attachment.

By providing a concentric integrated spatial relationship of the components of the unique dual stage pump portion wherein a primary small piston is longitudinally and concentrically disposed within a secondary large piston and having axial hydraulic fluid delivery, the entire pump assembly may be conveniently manufactured by conventional milling processes from metal stock. The adjacent work engaging cylinder and work piece puller shaft are also concentrically disposed, consequently the entire hydraulic pump, the various fluid ports and passageways, and the piston for the work engaging cylinder are integrated and are therefore manufactured from a single piece of metal stock by milling. Further advantages of the unique dual stage pump portion include the minimization of complex fluid ports and passageways, valves and other components typically utilized in dual stage hydraulic pumps wherein such configurations often require casted components. The reduced component requirement and simplified orientation of the elements significantly reduces manufacturing costs as well as the weight and size of the apparatus thereby fulfilling many objectives of the present invention and overcoming various disadvantages of related prior art tools.

A further objective of the present invention is to provide a power hand tool readily adaptable to both riveting and crimping operations. This objective is accomplished by providing a rivet setting embodiment wherein the work engaging cylinder and work piece puller shaft elements may receive a user provided typical riveter nose assembly. A user provided crimper head assembly received by an alternate embodiment of the tool wherein the tool piston portion and work engaging cylinder is accordingly adapted. The dual stage pump and hydraulics remain the same in this embodiment.

An operator uses the riveter embodiment of the tool by first installing an appropriate riveter nose assembly onto the work engaging cylinder and work piece puller shaft wherein the riveter nose assembly is selected to by its compliance with the rivet to be set. The tool is next positioned over the pin of the rivet. The operator next activates the tool by depressing the activator trigger. The activated tool thrusts the work engaging cylinder forward pushing the rivet while maintaining the rivet pin stationary. Once the rivet pin is pulled from the rivet, the trigger is released. The operator next reverses the work engaging cylinder by depressing the reversing trigger and the operation is complete.

BRIEF DESCRIPTION OF THE DRAWINGS

The accompanying drawings, which are incorporated in and constitute a part of this specification illustrate embodiments of the invention and, together with the description, serve to explain the features, advantages, and principles of the invention.

In the drawings.

DETAILED DESCRIPTION OF THE INVENTION

Figure 1:
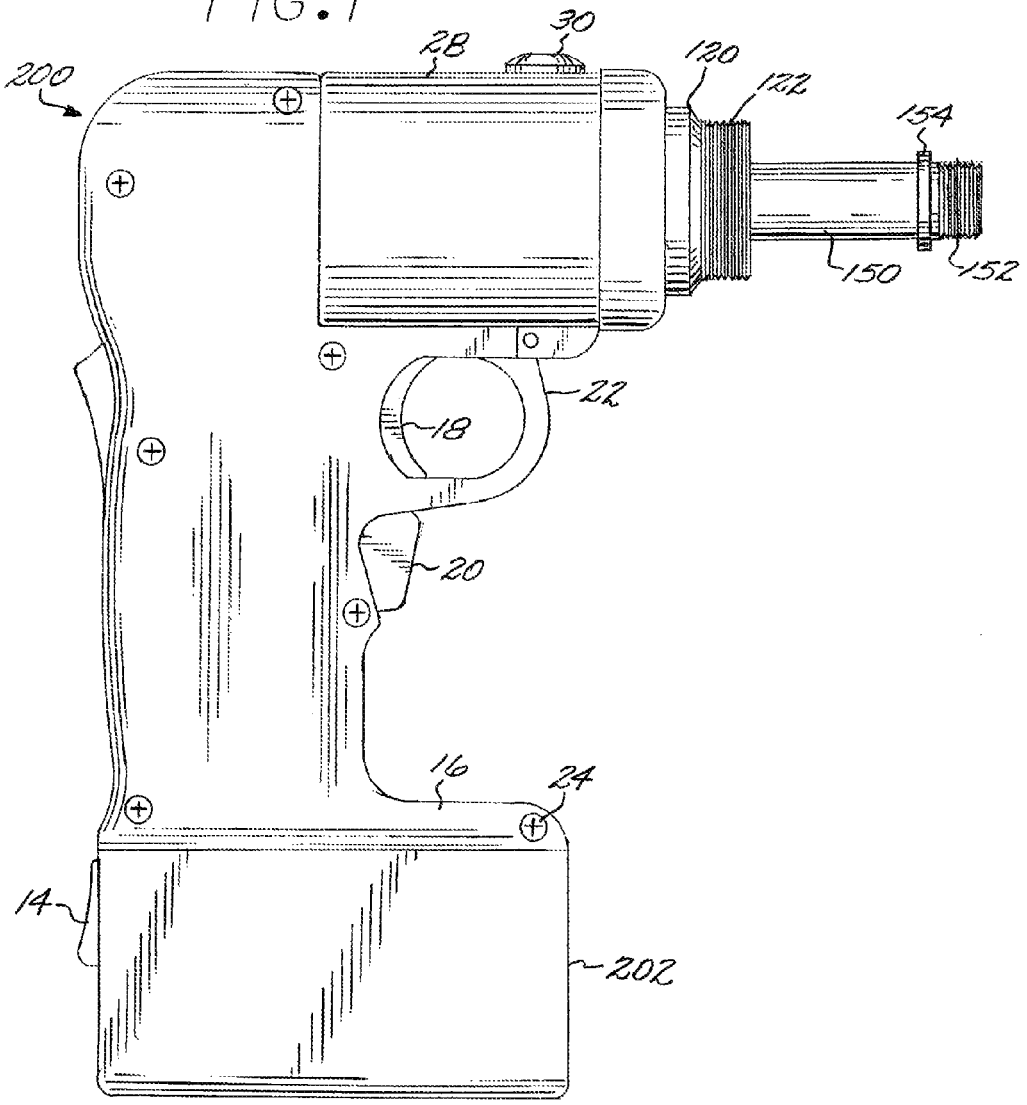
FIG. 1 is a right side elevation view of the electric-hydraulic riveter and crimper hand power tool according to the present invention wherein a removable rechargeable battery forms the bottom of the handle grip and a work piece shaft extends to the front to receive various tool nose assemblies.

Although particular embodiments of the invention have been described in detail for purposes of illustration, various modifications may be made without departing from the spirit and scope of the invention. Accordingly, the invention is not to be limited except as by the appended claims. Referring now in greater detail to the various figures of the drawings wherein like reference characters refer to like parts, there is shown in a right side elevation view at 200 in FIG. 1, a first embodiment of a new type of electric-hydraulic activated rivet and crimping hand power tool configured as a rivet setting tool.

FIG. 1 illustrates the right side elevation of the electric-hydraulic rivet fastener installation tool embodiment 200 according to the present invention with a design resembling a pistol gripped electric hand drill wherein a battery module 202 is removably attached to the bottom of the handle of the tool and secured by battery module release 14. The right side shell portion 16 forms an outer casing securing the components of the tool in spatial relationship and a convenient housing to grip and position the tool. A left side shell portion 26 has a mirrored construction such that the shell portions 16 and 26 form a complete housing around the tool when fastened together by shell fasteners 24. The tool is selectively user activated by depressing electric activation trigger 18 protected from accidental depression by activation trigger guard 22 formed within the shell pieces 16 and 26. A pressure relief and reversing trigger 20 is positioned below and adjacent to the activation trigger 18 for purposes of releasing hydraulic pressure within the tool after a fastener has been set so as to reset the positioning and retracting optional user supplied rivet setting nose assemblies after installing a fastener work piece.

Figure 2:
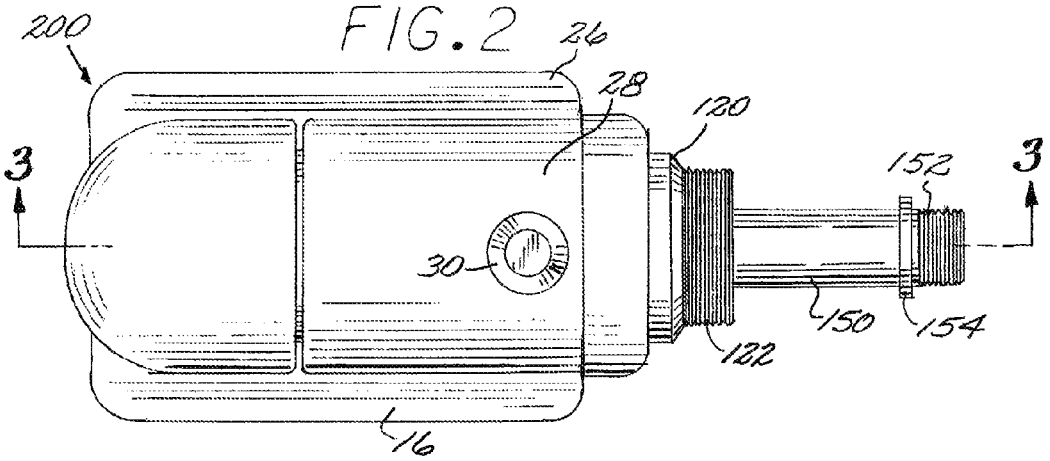
FIG. 2 is a top plan view of the electric-hydraulic riveter and crimper hand power tool of FIG. 1.
Figure 9:
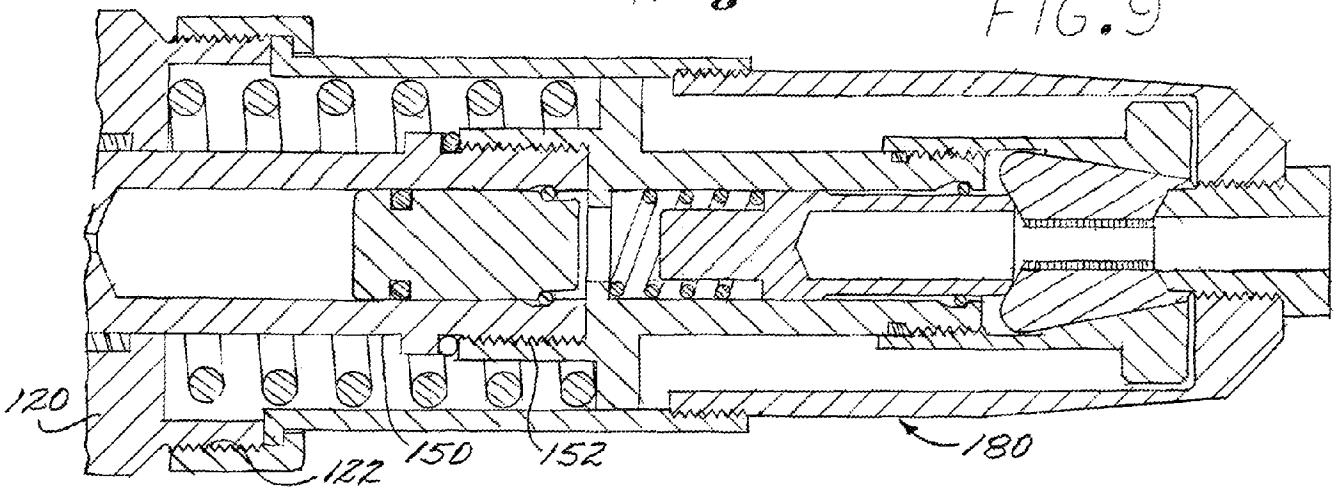
FIG. 9 is a cross section view similar to FIG. 3, taken along Line 3-3 of FIG. 2 illustrating a first optional nose assembly mounted to the work engaging cylinder and centrally fixed stationary work piece puller shaft.

As further illustrated in FIGS. 1 and 2, a work engaging cylinder 120 is thrust forward when the tool is activated while the centrally fixed work piece puller shaft 150 remains stationary relative to the tool. When configured as a riveter, the outer cone of a typical user supplied riveter nose assembly 180, well known in the art, as in FIG. 9, is screwed onto the nose assembly receiving threads 122 of the work engaging cylinder 120 and the work piece vice grip portion of a riveter nose assembly is screwed onto the nose assembly receiving threads 122 of the centrally fixed stationary work piece puller shaft 150 of the tool. During activation of trigger 18, the work engaging cylinder 120 moves forward relative to the stationary work piece shaft 100 wherein the pin of a rivet fastener is held stationary whilst the work engaging cylinder pushes the outer shell of a riveter nose assembly into the surrounding rivet material thereby providing the required rivet installation motion to pull a rivet pin from a rivet. Depressing the pressure relief trigger 20 permits the work engaging cylinder 120 to retract back into the tool.

Figure 3:
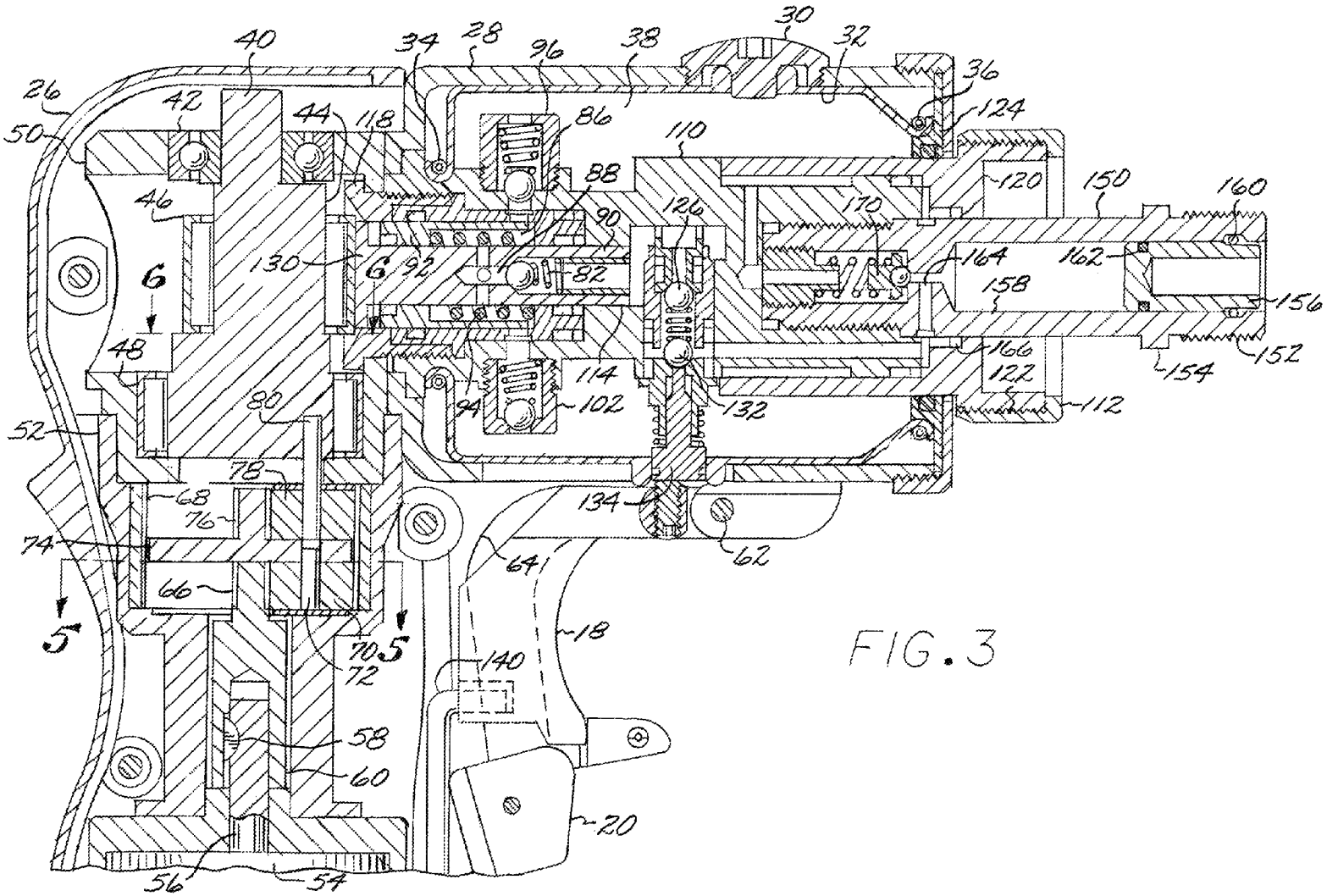
FIG. 3 is a cross section view of the upper portion of the electric-hydraulic riveter and crimper taken along Line 3-3 of FIG. 2 wherein the essential elements of the tool are illustrated including showing the spatial relationships of the electric drive motor, planetary drive, drive cam, primary hydraulic activator pump piston in the dual stage primary hydraulic cylinder, hydraulic check valves with pressure release, work engaging cylinder with piston surface, and centrally fixed work piece shaft with over pressure relief and work piece release mechanism.
Figure 5:
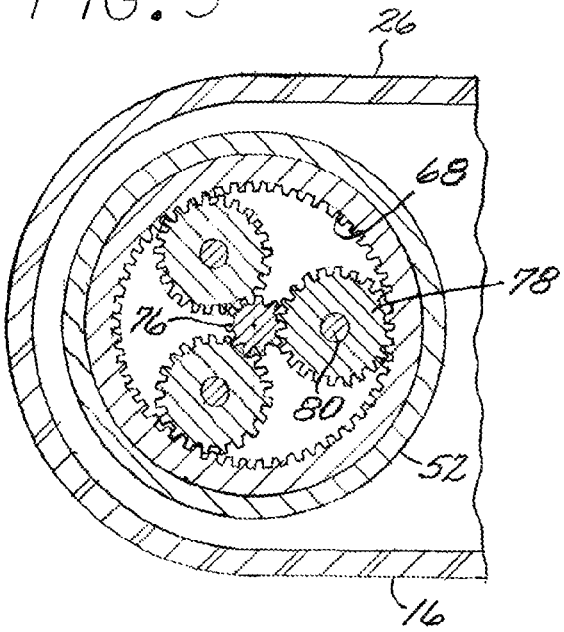
FIG. 5 is a cross section view, taken on Line 5-5 of FIG. 3, illustrating the electric motor to drive cam planetary gear mechanism.

Referring now to FIG. 3, being a partial cross section of the tool, and FIG. 5, a cross section taken along Line 5-5 of FIG. 3, the electric motor 54 is positioned in the drive cam lower gear housing 52 and oriented with the electric motor shaft 56 upwardly disposed and pressed onto the double planetary planet gear spindle 60 and secured by key 58. A primary sun gear 66 is disposed amongst three primary planetary planet gears 70 each rotatably mounted to downwardly disposed planet gear pin shafts 72 extending from the planetary gear drive disk 74. Centrally disposed in the planetary gear drive disk 74 is a secondary sun gear 76 facing upwardly and engaging three secondary planetary planet gears 78 rotatably mounted to secondary pin shafts 80 extending downward from the drive cam 40. Both the primary and secondary planetary gears engage a common planetary ring gear 68 fixed to the inner circumference of the drive cam lower gear housing 52. The double planetary gear drive provides a reduction ratio preferably of 28:1. As the lower portion of the drive cam 40 is secured in position by the drive cam lower thrust bearing 48 that is secured within the drive cam upper drive housing 50. The drive cam upper drive housing 50 and the drive cam lower gear housing 52 are secured together thus providing a rigid housing for the assembly. The upper portion of the drive cam 40 is secured by the upper drive cam support and thrust bearing 42 located at the top of the drive cam upper drive housing 50. The central portion of the drive cam 40 comprises an offset cam lobe 44 surrounded by the offset cam lobe bearing 46. The lobe bearing 46 is in direct mechanical contact with the small pump piston 90 of the dual volume, dual stage hydraulic pump assembly. It will be appreciated that activating the electric motor 54 rotates the drive cam lobe 44, being disposed off axis, around the vertical axis of the assembly thereby yielding a reciprocating motion of the pump pistons.

Figure 6:
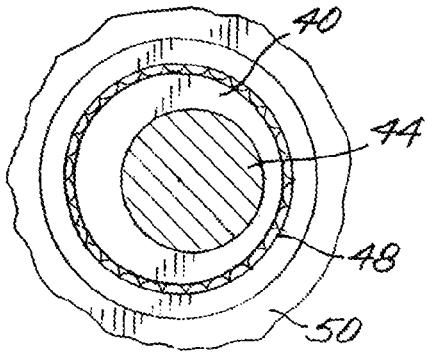
FIG. 6 is a cross section view, taken on Line 6-6 of FIG. 3, showing the offset positioning of the drive cam pump lobe.

FIG. 6, taken along Line 6-6 of FIG. 3, details the drive cam lobe 44 surrounded by drive cam lobe bearing 46 being disposed to rotate off axis of the vertical axis of the drive cam 40 that is mounted concentrically within the drive cam upper drive housing 50 and the drive cam lower gear housing 52.

Referring further to FIG. 3, the main body of the tool is the hydraulic piston body 110 being a continuous element comprising the unique dual volume, dual stage concentrically delivering longitudinally reciprocating piston pump and the piston for the work engaging cylinder. The pump assembly provides a high and a low stage pumping mechanism. When pumping in the high stage mode, the pump delivers a high volume of hydraulic fluid at low pressure preferably being 300 PSI. When pumping in the low stage mode, the pump delivers a low volume of hydraulic fluid at a high pressure preferably being 10,000 PSI. At a pressure of at least 300 PSI, the pump automatically transitions into low stage pumping as determined by the pressure relief setting of a high volume low pressure relief valve assembly 100 being in direct hydraulic communication with hydraulic fluid reservoir 38.

Figure 4:
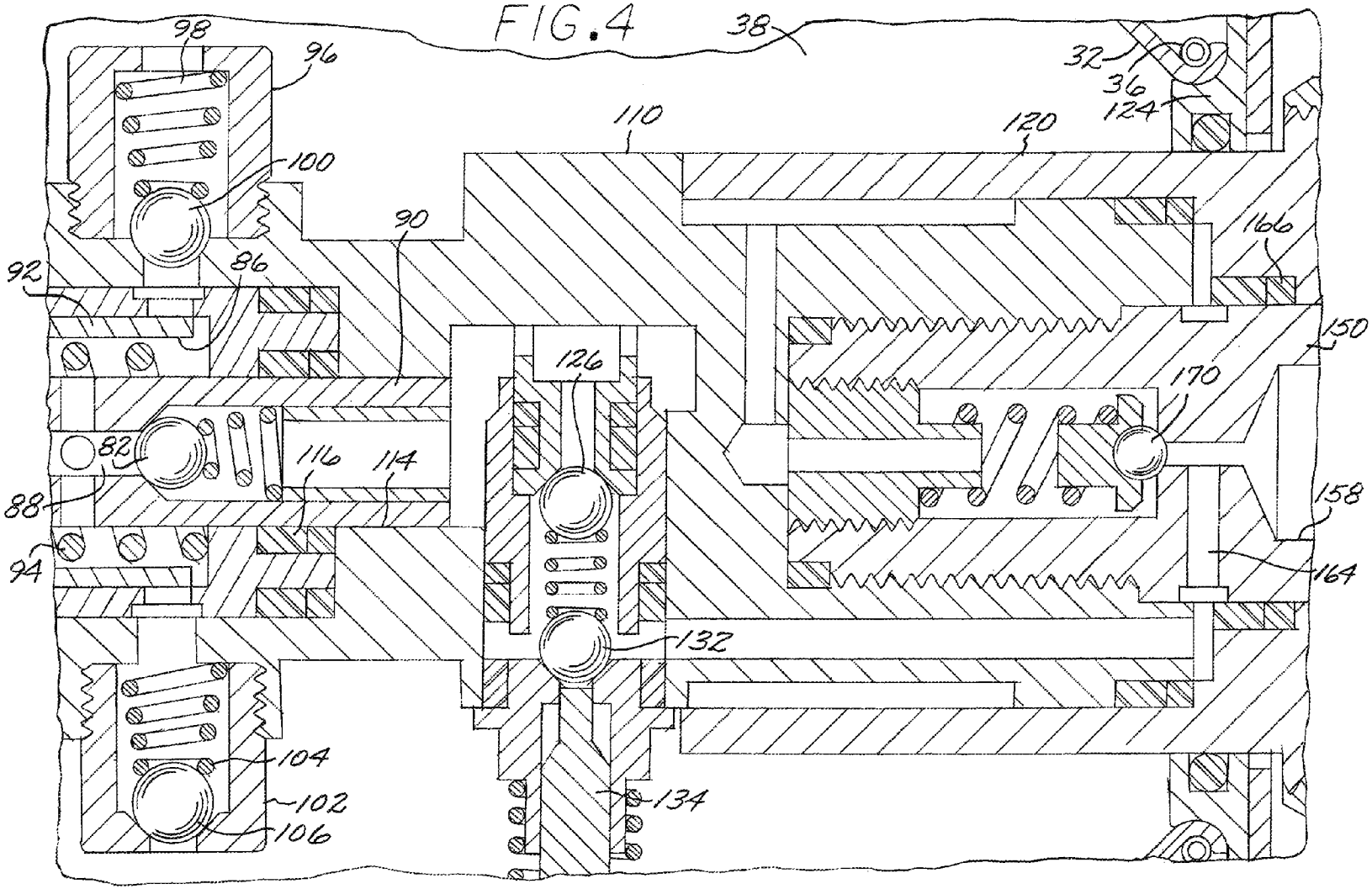
FIG. 4 is a cross section view showing details of the tool similar to FIG. 3, taken on Line 3-3 of FIG. 2, illustrating details of the hydraulic pathways and the spatial relationship of the hydraulic components.

FIGS. 3 and 4 illustrate details of the piston pump. The piston pump comprises a small piston 90 having a cam follower flange 130 forming the back of the small piston 90 and is in direct mechanical contact with the drive cam lobe bearing 44. The small piston is biased against the lobe bearing 44 by the large pump piston 92 that is further biased by large piston spring 94. The large pump piston 92 surrounds the small pump piston 90 concentrically mounted within the large pump piston 92. Both pistons are disposed within a pump cylinder bore within the hydraulic piston body 110. The small piston further comprises the combination check valve 82 concentrically mounted within the front end of the small piston 90 disposed to check flow downstream through the front of the small piston 90 and receiving hydraulic fluid from small piston hydraulic pathways 88 within the small pump piston being in direct hydraulic communication with the fluid surrounding the circumference of the small pump piston 90. The large pump piston 92 having a cavity within and surrounding the small pump piston 90 delivers hydraulic fluid into the small piston hydraulic pathways 88 at pressures and volumes commensurate with the displacement as defined by the inside diameter, depth of the cavity and the length of the stroke. The small pump piston 90 resides in a small pump piston cylinder bore 114 within the hydraulic piston body 110 and is capable of delivering fluid at a high pressure and low volume being limited by the diameter of the small piston and length of the stroke. Small piston seals 116 prevent downstream pressure delivery. During operation, the reciprocating small piston draws hydraulic fluid through the small pump piston hydraulic pathways 88 during the reverse stroke of the piston. Fluid passes through the pathways 88 and past the combination check valve 82 assembly. On the forward stroke, the combination check valve 82 closes and fluid is compressed into the work engaging cylinder through the work engaging cylinder inlet check valve 126 being downstream of the pump. On the back stroke, the large pump piston 92 follows the small pump piston 90 and also draws fluid into the large pump piston central cavity through two stage intake valve 102 that is in direct hydraulic fluid communication with the hydraulic fluid reservoir 38. On the forward stroke, the large pump piston 92, along with the small pump piston 90, is thrust forward by the flange 130 of the small pump piston 90, compressing fluid within the large and small pump piston cavities. The pressure within the large piston cavity 86 is proportionally less than the compressed fluid in the small pump piston 90 however can provide a larger volume of fluid at the low pressure than the smaller volume at the higher pressure of the small pump piston. During a forward stroke, if the pressure downstream of the pump is low, the combination check valve 82 opens because the large pump pressure exceeds the downstream pressure thus delivering fluid from both the small and large pump pistons during the stroke. Consequently, the small and large pump pistons working in cooperation to deliver fluid at a low pressure and high volume when the downstream pressure in the work engaging cylinder 120 is low and conversely to deliver fluid at a high pressure and low volume when the downstream pressure of the work engaging cylinder 120 is high. The transition from high to low stage pumping is therefore accomplished by the single high volume low pressure relief valve 96 assembly thereby significantly reducing the components typically required of prior art pumps.

As the transition pressure between high and low stage is predetermined by the pressure relief setting of the high volume low pressure relief valve 96 spring 98 setting, an analogous mechanism is implemented to set the low stage maximum pressure. The work engaging cylinder pressure relief valve 170 is set to a predetermined maximum pressure for the low stage pumping. Valve 170 being in direct hydraulic fluid communication between the work engaging cylinder 170 interior cavity and the reservoir and further restricting flow from the cavity to the reservoir, fluid is vented from the pump at the predetermined maximum pressure thereby limiting the low stage maximum pump pressure. The concentric arrangement of the large 92 and small 90 pistons, combination check valve 82, and high volume low pressure relief valve 96 cooperate allowing both large and small piston volumes to discharge downstream with preference given to the higher pressure fluid in the small piston 90 thereby providing a simple and efficient two stage pumping mechanism.

The hydraulic piston body 110 is fastened to the drive cam upper housing 50 by a concentric nut 118 at the rear of the pump securing the housing to the pump thereby maintaining contact between the drive cam lobe 44 and the cam follower flange 130 of the small pump piston 90.

Referring further to FIG. 3, the hydraulic fluid reservoir bladder 32 has generally a cylindrical shape and is sealed to the hydraulic piston body 110 and the work engaging cylinder front seal 124 respectively by rear and front bladder retainer rings 34 and 36, together defining the confines of the hydraulic fluid reservoir 38. All fluid pathways requiring access to the reservoir are disposed with hydraulic fluid communication with the reservoir. A reservoir fill plug 30 is provided for replenishment and replacement of fluid. The reservoir 38 is protected by the reservoir outer casing 28 forming, in cooperation with the shell portions 16 and 26, a portion of the protective housing of the tool.

Also in FIGS. 3 and 4, the work engaging cylinder 120 surrounds the hydraulic piston body 110 forming a hydraulic cylinder arrangement wherein fluid received from the pump is retained behind the work engaging cylinder 120 by work engaging cylinder inlet check valve 126. As the cylinder is pressurized and filled with hydraulic fluid, the work engaging cylinder 120 is thrust forward. Before the tool engages a work piece, the pump delivers fluid in high stage mode at low pressure and high volume thereby quickly moving the work engaging cylinder forward. However, once the tool engages a work piece additional pressure is required from the pump and the pump now transitions into low stage providing high pressures with considerably less displacement of fluid. When the maximum low stage pressure is achieved either by restricting the forward movement of the work engaging cylinder by the stop collar 154 on the work piece puller shaft 150 or by unyielding work pieces, a high pressure relief valve 170 preset at the maximum low stage maximum pressure is provided having direct hydraulic fluid communications between the hydraulic reservoir and the hydraulic cylinder of the work engaging cylinder wherein fluid is dumped to the reservoir 38.

The combination of a fixed work piece puller shaft and a surrounding work engaging cylinder provides a number of important advantages. In particular, the inside portion of the work engaging cylinder 120 engages the hydraulic piston body 110, forming the confines of a hydraulic cylinder, also cylindrically shaped, wherein the bottom of the hydraulic cylinder forms a large surface area thereby amplifying the hydraulic force advantage of the pressurized hydraulic fluid pumped into the cylinder during operation. Consequently high thrusting forces may be achieved. The work engaging cylinder 120 further has a work piece puller shaft bore in the bottom of the hydraulic cylinder wherein the work piece puller shaft 150 being centrally fixed to the hydraulic piston body 110, is slidably positioned. Seals 166 between the work engaging cylinder 120 and the work piece puller shaft 150 retain the hydraulic fluid within the hydraulic cylinder of the work engaging cylinder 120 when the work engaging cylinder thrusts forward during activation.

A further advantage of utilizing the surrounding work engaging cylinder 120 configuration is to facilitate other uses of the pressurized hydraulic fluid within the hydraulic cylinder of the work engaging cylinder 120. As the forward thrust force of the work engaging cylinder 120 is, in part, determined by the surface area of the bottom of the hydraulic cylinder of the work engaging cylinder 120, other mechanisms requiring a lower thrust force are facilitated by having a smaller surface area exposed to the pressurized hydraulic fluid. One such mechanism is the work piece puller shaft release mechanism according to the present invention. The work piece puller shaft 150 further comprises a central hydraulic plenum cylinder 158 wherein a release piston 156, located at the distal end of the work piece puller shaft 150, retained by piston retainer ring 160 and seals 162, receives hydraulic fluid pressure at the same pressure as the work engaging cylinder 120 through hydraulic fluid passageways 164 from the circumferential surface of the work piece puller shaft 150. As the surface area of the bottom of the release piston 156 is smaller than that of the work engaging cylinder 120, the release piston force does not overcome the forward thrust of the work engaging cylinder 120 during setting of a rivet. However, when the pressure is relieved after setting a rivet and the work engaging cylinder 120 contacts the stop collar 154 of the work piece puller shaft 150, the release piston 156 forward force exceeds that of the work engaging cylinder 120 and the release piston 156 moves forward to eject a remaining rivet pin held within the riveter nose assembly.

It will be appreciated that in configurations wherein a pin and collar type nose assembly is optionally threaded to the receiving threads 152, the release piston 156 presses against a set pin and collar fastener's stem acting as an anvil to force off the work piece.

The work engaging cylinder dump valve 132 is biased closed and remains closed until the user depresses the pressure release and reversing trigger 20. Depression of the trigger 20 rotates the pressure relief lever 64 around actuator trigger and pressure relief trigger pivot 62 forcing the dump valve pin 134 upwards thereby lifting the ball of the dump valve 132 allowing fluid flow past the valve and into the surrounding hydraulic fluid reservoir 38 thereby removing pressure from the work engaging cylinder and allowing the cylinder, under spring load from a riveter nose assembly, slide back over the hydraulic piston body to its resting position.

Figure 8:
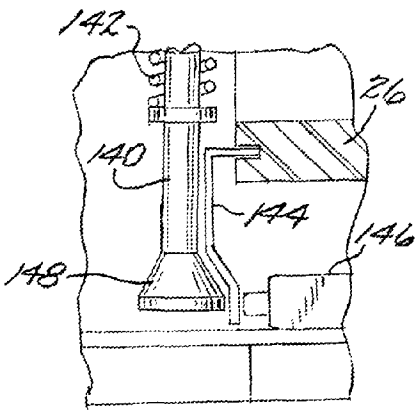
FIG. 8 is an inset view of the trigger switch mechanism taken along Line 8-8 of FIG. 7.
Figure 7:
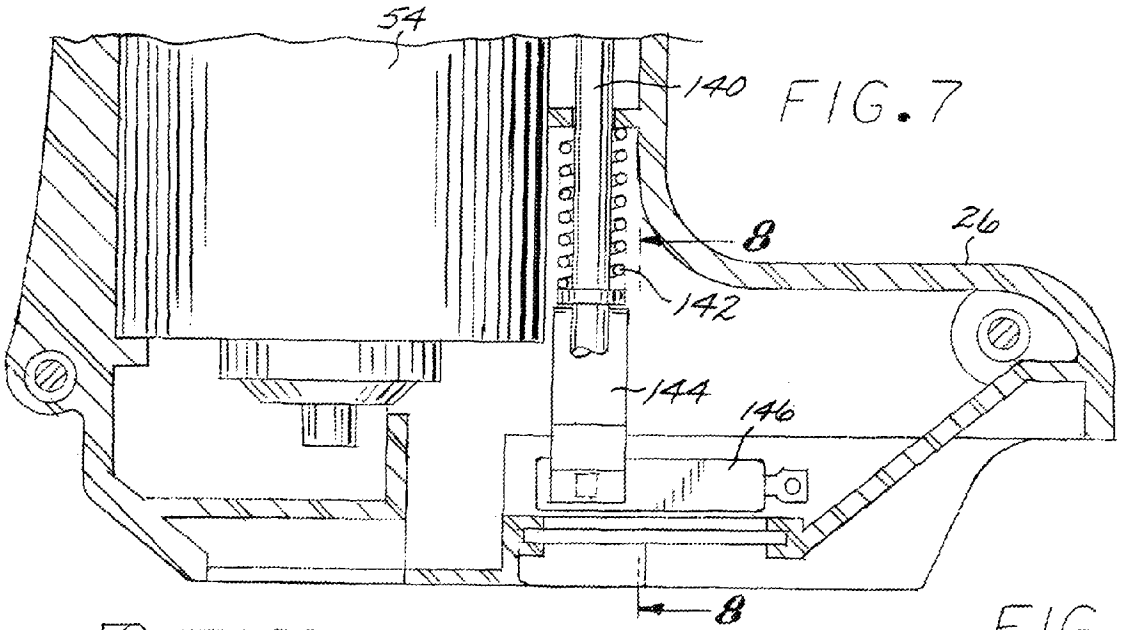
FIG. 7 is a cross section view of the lower portion of the electric-hydraulic tool, similar to FIG. 3, taken along Line 3-3 of FIG. 2, illustrating details of the spatial relationship of the components of the trigger switch mechanism.

The electric activator trigger 18 is selectively depressed by a user to activate the tool. The trigger 18 is a lever element pivoting around activator trigger and pressure relief trigger pivot 62. The trigger 18 is so disposed as to lift the electrical activator trigger switch rod 140 having a right angle bend in the proximate end received by a slot in the trigger 18. The rod 140 is disposed downwardly within the tool shell casing and biased downwardly by electrical activator trigger switch rod bias spring 142. The distal end of the rod 140 has a downwardly disposed cone enlargement 148. A deflection plate 144 is shaped to conform to the vertical shape of the rod and cone enlargement at the bottom end and similarly disposed adjacent to the rod 140, and having a right angle bend in the top end retained in a slot in the case housing. An electrical switch 146 being in direct electrical communication with the battery module 202 and electric motor 54 is disposed adjacent to the bottom end of the deflection plate 144 as in FIG. 8. A depression of the trigger 18 therefore moves the trigger rod 140 upwards through the casing, and the conically shaped end interferes with the deflection plate 144 pushing the plate into the switch 146 thereby activating the switch and hence the tool.

Figure 10:
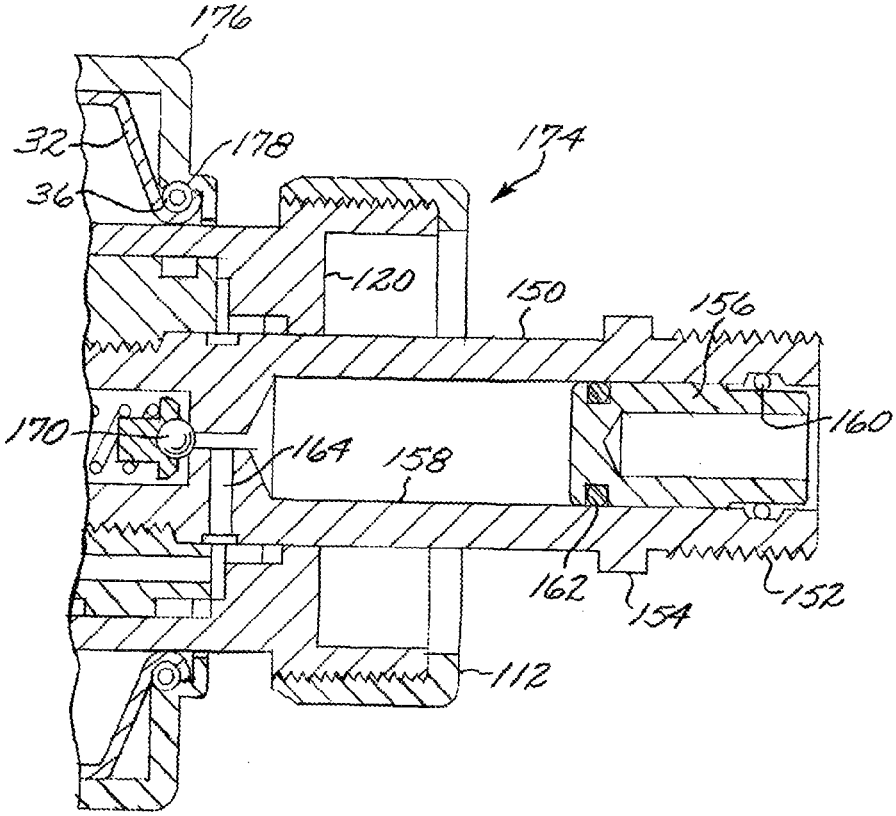
FIG. 10 is a cross section view similar to FIG. 3, illustrating a first alternate embodiment of the tool wherein the front portion of the hydraulic fluid reservoir bladder forms a hydraulic fluid sealing surface with the work engaging cylinder.

A first alternate embodiment of the tool 174, in FIG. 10, is shown in a cross section view similar to FIG. 3 wherein the bladder front retainer ring 36 secures the hydraulic fluid reservoir bladder 32 in position such that the bladder contacts the work engaging cylinder 120 directly. The bladder is held in position and compression by ring 36 gripped in bladder groove 178 in an alternate embodiment of the reservoir outer casing 176. Being in slidable contact with the work engaging cylinder 120 directly, the bladder 32 forms a hydraulic seal with the surface of the work engaging cylinder 120 as the cylinder moves during operation of the tool. The alternate embodiment, as illustrated, facilitates lower cost manufacturing.

Figure 11:
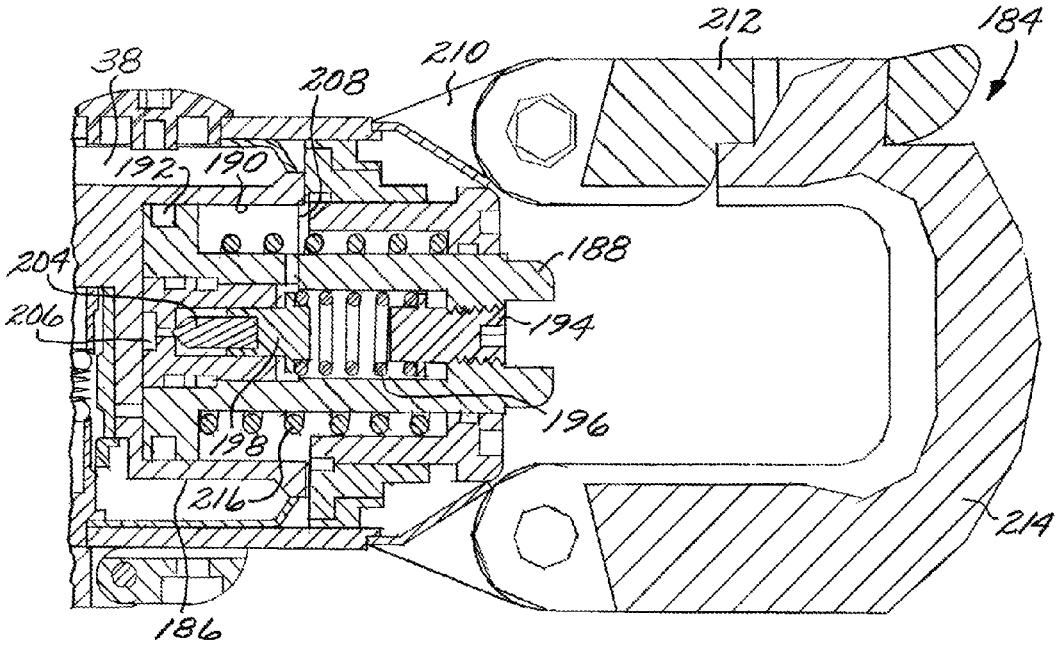
FIG. 11 is a cross section view similar to FIG. 3, illustrating a second alternate embodiment of the tool wherein the front portion of the tool is adapted to receive a crimping head.

A second alternate embodiment of the tool 184, in FIG. 11, is shown in a cross section view similar to FIG. 3 wherein the hydraulic piston body 186 of the tool has been adapted to form a crimper hydraulic piston body cylinder portion 190 dimensioned to receive a crimper work engaging piston 188 with crimper work engaging piston seal 192 inter-disposed. Hydraulic received from the pumping section of the tool is in direct hydraulic fluid communication with the crimper work engaging piston 188 and is thrust forward as pressure increases from the pump. This second alternate embodiment has a crimper head base 210 secured to the front end of the adapted crimper hydraulic piston body. The crimper head base 210 pivotally receives a typical crimper head clasp 214 and crimper head clasp lock 212. With a work piece provided within the crimper head clasp, the tool is activated as in other embodiments forcing the crimper work engaging piston to push forward into the crimper head thereby engaging a work piece. During the crimping process, the hydraulic fluid pressure increases as the work piece is compressed until the crimper maximum pressure relief valve piston 198 lifts relief valve sealing pin 204 from the relief valve seat 206. Being in direct communication with the hydraulic fluid from the pump, the relief valve piston 198 allows the sealing pin 204 to lift from the seat 206 thereby relieving hydraulic fluid back to the hydraulic reservoir 38 through crimper relief hydraulic fluid pathway 208.

Referring further to FIG. 11, the relief pressure of the crimp tool embodiment is set by a combination of the crimper maximum pressure relief valve spring 196 and the crimper relief pressure adjustment screw 194. The adjustment screw 194 is threaded into the front end of the crimper work engaging piston 188. Threading the adjustment screw inwards increases the tension on the valve spring 196 increases the relief pressure. The crimper relief pressure adjustment screw 194 is accessible from outside the tool thereby providing simple maximum pressure adjustment. A crimper work engaging piston bias spring 216 disposed within the crimper hydraulic piston cylinder 190 and the crimper work engaging piston 188 forces the work engaging piston 188 into the bottom of the piston cylinder 190 so as to retract the work engaging piston 188 into the tool when the tool is deactivated and pressure is relieved.

The embodiments herein provided illustrate adaptation of the tool for riveters and crimpers; however, it will be appreciated that other adaptations of the hydraulic piston body may be made to receive a variety of tool heads.

What is claimed is:

1. An electrically and hydraulically powered rivet setting and crimping hand power tool comprising, a hydraulic piston body having front and rear ends, the front end being a hydraulic piston, the rear end being a reciprocating piston pump housing, a work engaging cylinder surrounding and slidably engaging the hydraulic piston of the hydraulic piston body, a reciprocating piston pump being concentrically and longitudinally disposed within the rear end housing of the hydraulic piston body and having a pump small piston, having a front portion and having a cam follower flange disposed at the rear of the hydraulic piston body, a drive cam being perpendicularly positioned adjacent to the rear of the hydraulic piston body and having an offset cam lobe disposed to engage the cam follower flange of the pump small piston with the offset cam lobe arranged to reciprocate the pump small piston longitudinally respectively and responsively to the rotation of the drive cam, and an electric motor in mechanical communication with the drive cam wherein the drive cam rotates responsively to the activation of the electric motor.

2. The hand power tool of claim 1 further comprises a planetary gear disposed between the electric motor and the drive cam.

3. The hand power tool of claim 1 further comprising a battery module being in direct electric communication with the electric motor and an activator trigger switch.

4. The hand power tool of claim 1 wherein the small piston of the reciprocating pump further has a rear portion and is centrally and longitudinally disposed within the reciprocating pump housing of the hydraulic piston body and the reciprocating piston pump further comprising a large piston, having front and rear portions, surrounding the circumference of the small piston and the rear portion slidably engaging the circumference of the small piston and limited by the cam follower flange of the small piston, the front portion forming a cavity around the small piston and having a spring disposed within the cavity between the large piston and the pump housing, biasing the large piston towards the cam follower flange of the small piston, a small piston hydraulic pathway disposed within the small piston having direct hydraulic fluid communication between the cavity of the large piston and a combination check valve centrally disposed within the front portion of the small piston, the combination check valve being biased closed towards the hydraulic pathway allowing one directional flow of hydraulic fluid out the front portion of the small piston from the cavity of the large piston, a small piston cylinder bore centrally and longitudinally disposed in the hydraulic piston body slidably receiving the front portion of the small piston, and a large piston cylinder bore centrally and longitudinally disposed in the rear portion of the hydraulic piston body contiguous with the small piston cylinder bore, and having an hydraulic pathways between a hydraulic reservoir and the cavity of the large piston wherein reciprocating movement of the cam follower flange of the small piston draws hydraulic fluid into the cavity of the large piston on a reversing stroke and forces fluid through the combination check valve and out the front portion of the small piston on the forward stroke.

5. The hand power tool of claim 4 further comprising an intake check valve being in direct hydraulic fluid communication with the hydraulic fluid reservoir and the cavity of the large piston providing one directional flow from the hydraulic fluid reservoir to the cavity.

6. The hand power tool of claim 4 further comprising a relief valve being in direct hydraulic fluid communication with the cavity of the large piston and the hydraulic fluid reservoir and providing one directional flow from the cavity to the hydraulic fluid reservoir, the relief valve having a spring tensioned to open the valve and communicate hydraulic fluid to avoid over pressure damage of the tool and to coordinate with the spring of the large piston transitioning the reciprocating pump from a high volume low pressure pump mode to a low volume high pressure pump mode.

7. The hand power tool of claim 1 wherein the front portion of the small piston is in direct hydraulic fluid communication with a work engaging cylinder inlet check valve providing one directional flow of hydraulic fluid into the work engaging cylinder forcing the work engaging cylinder to travel forward along the hydraulic piston of the hydraulic piston body.

8. The hand power tool of claim 7 wherein a work engaging cylinder pressure relief valve is in direct hydraulic fluid communication with the work engaging cylinder and the hydraulic fluid reservoir providing one directional flow of hydraulic fluid into the hydraulic fluid reservoir, the work engaging cylinder pressure relief valve selected to permit hydraulic fluid flow at pressures that damage the tool.

9. The hand power tool of claim 7 wherein a dump valve is disposed opposing the work engaging cylinder inlet check valve having direct hydraulic fluid communication with the work engaging cylinder and the hydraulic fluid reservoir, the dump valve being a ball valve and having a dump valve pin disposed to open the valve when depressed, the pin being engaged by a pressure release and reversing trigger actuator selectively activated by a user for relieving the hydraulic fluid from the work engaging cylinder thereby retracting the tool from a work piece.

10. The hand power tool of claim 4 wherein the hydraulic piston body and the work engaging cylinder have outside circumferences and the hydraulic fluid reservoir is defined by the outside circumference of the hydraulic piston body, the outside circumference of the work engaging cylinder and a bladder.

11. The hand power tool of claim 3 further comprising a tool case providing a housing for the tool having a grip with an electrical activator trigger engaging the top end of a trigger switch rod disposed within the grip, the trigger switch rod having an expanded bottom end disposed to engage a trigger switch deflection plate when the activator trigger is depressed by a user and responsively disposing the deflection plate to engage and depress the activator trigger switch thereby activating the electric motor.

12. The hand power tool of claim 7 wherein the hydraulic piston body further comprises a work piece puller shaft forming the front end of the hydraulic piston body, the puller shaft having a plenum cylinder centrally and longitudinally disposed within the front end of the shaft and being in direct hydraulic fluid communication with the work engaging cylinder, and a release piston slidably engaging the inside bore of the plenum cylinder arranged to move forward with increasing volume of hydraulic fluid within the cylinder, the hydraulic fluid communication flow being restricted wherein a rapid lowering of the hydraulic fluid pressure in the work engaging cylinder facilitates a pressure difference thrusting the release piston forward to disengage a work piece for riveter configurations of the tool.

13. The hand power tool of claim 1 wherein the hydraulic piston and work engaging cylinder receive a riveter tool head attachment.

14. The hand power tool of claim 1 wherein the hydraulic piston and work engaging cylinder receive a crimper tool head attachment.

* * * * *